United States Patent [19]

Boutros

[11] Patent Number: 4,950,185

[45] Date of Patent: Aug. 21, 1990

[54] STRESS ISOLATED PLANAR FILTER DESIGN

[75] Inventor: Kamal S. Boutros, Downsview, Canada

[73] Assignee: Amphenol Corporation, Wallingford, Conn.

[21] Appl. No.: 353,480

[22] Filed: May 18, 1989

[51] Int. Cl.[5] ..... H01R 13/66

[52] U.S. Cl. ..... 439/620; 333/103; 439/609

[58] Field of Search ..... 439/620, 609

[56] References Cited

U.S. PATENT DOCUMENTS

| | | | |
|---|---|---|---|
| 3,538,464 | 11/1970 | Walsh | 333/79 |
| 4,079,343 | 3/1978 | Nijman | 333/183 |
| 4,187,481 | 2/1980 | Boutros | 333/182 |
| 4,262,268 | 4/1981 | Shimada et al. | 333/182 |
| 4,276,523 | 6/1981 | Boutros et al. | 333/182 |
| 4,296,390 | 10/1981 | Vanderheyden et al. | 333/182 |
| 4,494,092 | 1/1985 | Griffin | 333/183 X |
| 4,674,815 | 6/1987 | Chambers et al. | 439/592 |
| 4,679,013 | 7/1987 | Farrar et al. | 333/182 |
| 4,707,048 | 11/1987 | Gliha et al. | 439/620 |
| 4,741,710 | 5/1988 | Hogan et al. | 439/620 |
| 4,820,202 | 4/1989 | Edwards et al. | 439/620 |

*Primary Examiner*—Eugene F. Desmond

*Attorney, Agent, or Firm*—Bacon & Thomas

[57] ABSTRACT

A planar filter array is completely isolated from mechanical and thermal stresses by an arrangement of resilient planar gaskets which sandwich said array and electrical contact springs which also serve to isolate the array from mechanical and thermal stresses and which permit electrical connection of the individual filters in the array to external devices. The filter array and gaskets are inserted into a housing to form a filtered electrical connector, the filters in the array being connected to the housing via grounding springs and to connector pins via contact springs placed in apertures in the array. The filters may be simple capacitive filters or pi filters formed of cylindrical ferrite inductors sandwiched between the capacitor arrays and embedded in a resilient planar gasket.

6 Claims, 2 Drawing Sheets

STRESS ISOLATED PLANAR FILTER DESIGN

FIELD OF THE INVENTION

This invention relates to stress isolation of filter arrays, and in particular to stress isolation of planar filter arrays in a filter connector.

DESCRIPTION OF RELATED ART

The use of filters in connectors is often critical to protect sensitive components from transient currents and voltages which might develop in a signal transmission cable due to electromagnetic and radio frequency interference. Such transients are generally high frequency in nature, and therefore capacitive or tuned pi circuits are used to shunt the transients to ground without affecting the primary signal carried by the cable.

Sophisticated ceramic technology has allowed such filters to fit within the connectors themselves. However, such ceramic filter arrays are brittle and vulnerable to mechanical and thermal stresses on the connector. Conventional arrangements for isolating the filter arrays have proven inefficient, expensive, and overly complicated. Consequently, a long-felt need exists for an efficient stress isolation arrangement for ceramic filter arrays which is both inexpensive and easy to assemble.

SUMMARY OF THE INVENTION

It is an object of the invention to provide improved means for isolating filter arrays from mechanical and thermal stresses.

It is a further object of the invention to provide improved stress isolation of planar ceramic filter arrays.

It is a still further object of the invention to provide an improved multi-pin connector which includes stress isolated planar capacitor filter arrays, and which is easily assembled.

Finally, it is an object of the invention to provide an improved multi-pin connector which includes stress isolated pi filters formed of planar ceramic capacitor arrays and cylindrical ferrite inductors, and which is easily assembled.

These objects are accomplished by providing resilient gaskets which sandwich the planar filter arrays to isolate them from shocks and stress.

These objects are further accomplished by providing a connector which includes planar filter arrays sandwiched by resilient planar gaskets, and wherein the filters are connected to ground via grounding springs which serve to provide additional isolation for the filter arrays from thermal and mechanical stress.

DESCRIPTION OF THE PREFERRED EMBODIMENTS

Figure 1:
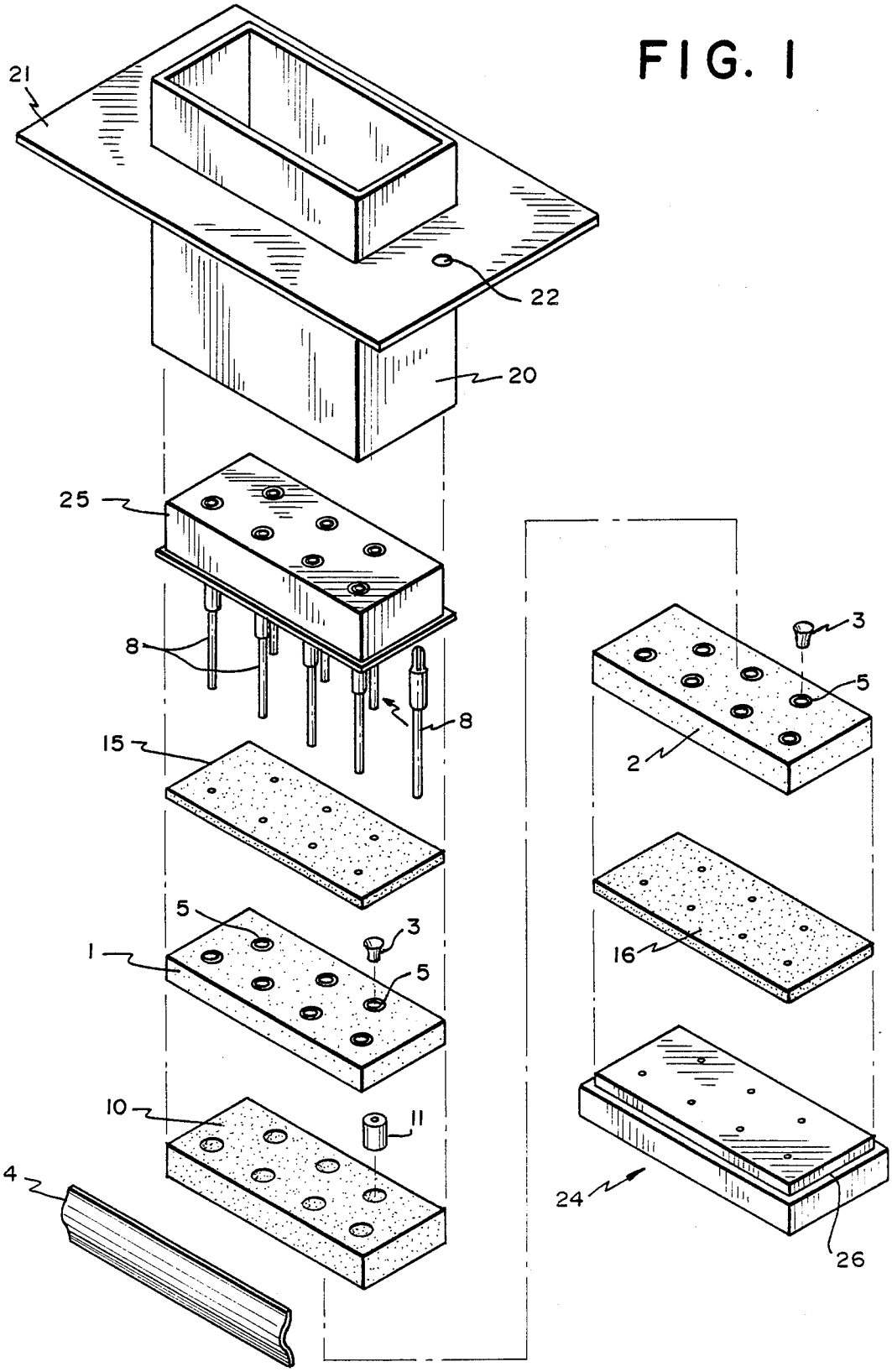
FIG. 1 is a perspective exploded view of a connector according to a first preferred embodiment of the invention.
Figure 2:
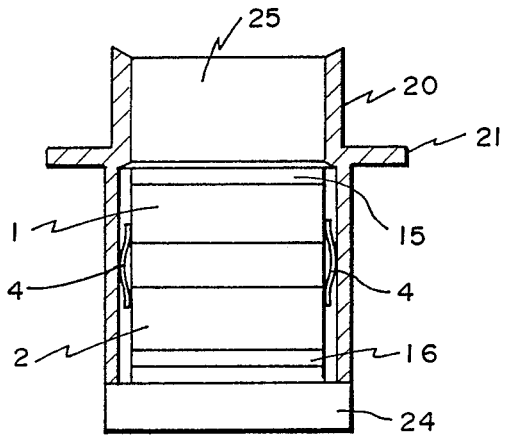
FIG. 2 is a cross-sectional side view of the connector of FIG. 1.

FIGS. 1 and 2 show a connector which exemplifies the principles of the invention. The connector includes a housing shell 20, preferably made of a conductive material such as aluminum. Other suitable materials include metals or conductive plastics, and the housing itself may be made of a single molded piece or may consist of several parts.

The housing 20 includes a flange 21 which in turn includes means such as screw holes 22 for securing the connector to an electronic device. The shell 20 and connecting means 22 may be used to provide a ground path for the filters in the connector as will be described below. In addition, the flange 21, combined with the conductive shell 20, provides increased electromagnetic interference protection.

Figure 4:
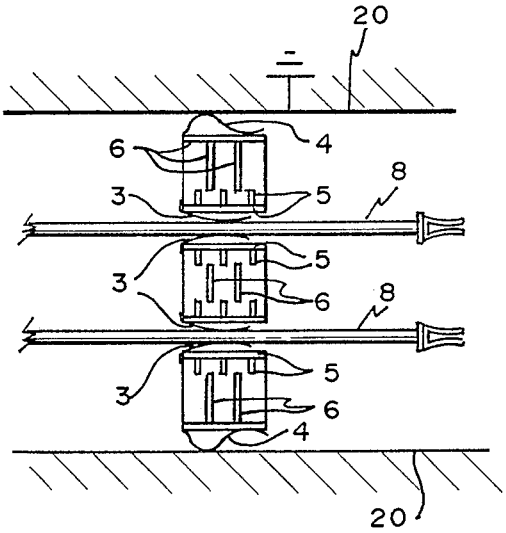
FIG. 4 is a side view depicting the manner in which the circuit of FIG. 3 is mounted in a connector.

Electrical signals pass through the connector along a path provided by pins 8, which are configured as best shown in FIG. 4 to provide receptacles for the insertion of male connector pins at one end. It is, however, equally possible to configure pins 8 as male connection pins in a manner well known in the art.

The pins 8 are inserted in receptacle 25 which fits inside housing shell 20. Receptacle 25 is preferably made of a hard dielectric material. Apertures in the receptacle receive the pins 8 on one side and external connector pins on the other side in a conventional manner.

The opposite ends of pins 8 are inserted in a rigid insert 24 which serves as an end cap for the connector housing 20 and as a means by which a cable or other electrical device is electrically connected to the connector pins. The means by which the cable is connected to the connector pins forms no part of the present invention, but is noted that diverse such means are known to those skilled in the art.

Figure 6:
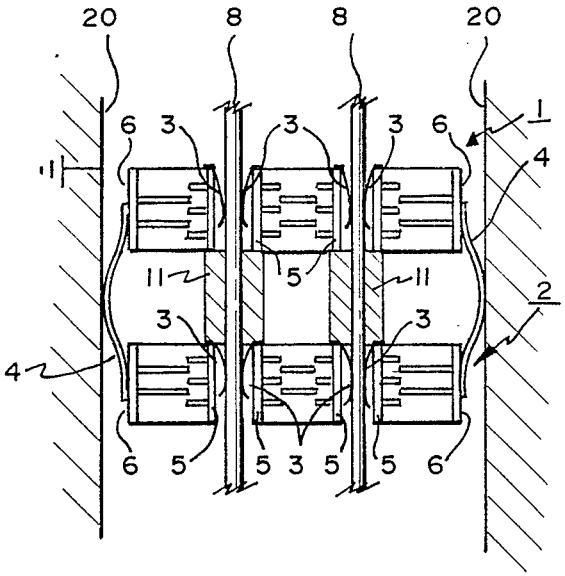
FIG. 6 is a side view showing the manner in which the filter of FIG. 5 is mounted in a connector.

Elements 1 and 2 are planar ceramic capacitor arrays of the type shown in more detail in FIGS. 4 and 6. The use of the arrays shown in FIGS. 4 and 6 is not exclusive, however, it being possible to also include arrays of discrete capacitors embedded in a solid insulative material, or to use arrays of circuit elements other than capacitors.

As shown in FIGS. 4 and 6, planar capacitor arrays 1 and 2 are each formed of a plate of ceramic material including buried interleaved conductive electrodes 5 and 6. The plate includes openings of sufficient diameter to permit insertion of pins 8.

The pins 8 are connected to pin electrodes 5 by contact springs 3 inserted in the openings which serve to electrically connect pin electrodes 5 with pins 8, and also to secure pins 8 in the holes, while providing mechanical stress isolation between the pins and the plates.

Surrounding the perimeter of each capacitor plate is a ground electrode electrically connected to alternate ones of the interleaved buried electrodes 6 as shown. Capacitor plates 1 and 2 are dimensioned to fit within housing 20 with a slight clearance such that ground electrode 6 may be electrically connected to housing 20 by a grounding spring 4, which also serves to isolate the capacitor array plates 1 and 2 from mechanical stresses on the housing shell 20.

The use of springs 4 permits secure electrical contact between the ground electrode 6 and the housing shell 20 while also simplifying assembly by permitting a clearance between the plates and the housing. Each of the components shown in FIGS. 1 and 2 can be easily inserted in housing 20.

To further secure capacitor plates 1 and 2 in housing 20, and to provide a additional stress isolation with an extremely simple structure, gaskets 15 and 16 are provided. Each gasket includes apertures for the insertion of pins 8. The gaskets are dimensioned to securely fit within housing shell 20.

Gaskets 15 and 16 may be made of any insulating material with sufficient resilience to provide isolation from both mechanical and thermal stresses. Silicon rubber has proved especially advantageous.

Each of the elements 1, 2, 10, 15 and 16 shown in FIG. 1 (element 10 will be described below) may be inserted into housing shell 20 without additional adhesives, although the use of adhesives in connection with the above-described structure is within the scope of the invention. Insert 24 provides a convenient cap for securing the gaskets and filter elements in the housing, and may include a shelf 26 as shown to which adhesive can be applied to seal the connector.

Figure 3:
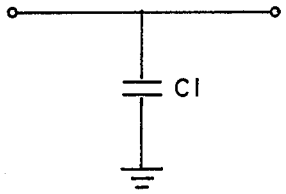
FIG. 3 is a schematic diagram of a capacitive filter circuit according to a second preferred embodiment of the invention.
Figure 5:
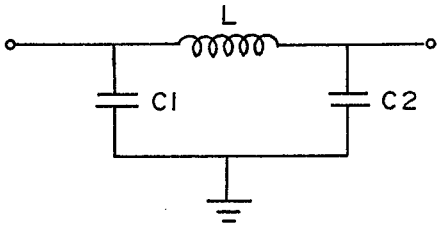
FIG. 5 is a schematic diagram of a pi filter according to the first preferred embodiment of the invention.

FIGS. 3 and 5 show two different types of filters to which the invention may be applied. The filter of FIG. 3 is a simple capacitive filter implemented as shown in FIG. 4 by a planar capacitor array electrically connected to ground through grounding spring 4 and the housing 20. The pin electrodes 5 of the capacitor are electrically connected to the pins 8 through contact springs 3, as described above, and the capacitor array is directly sandwiched between gaskets 15 and 16.

Thus, the capacitor array shown in FIG. 4 is completely isolated from stresses in all directions, whether mechanical or thermal in nature.

The pi filters of the embodiment shown in FIGS. 5, 6 and also in FIGS. 1 and 2 include two capacitor arrays and cylindrical ferrite inductors 11 which encircle pins 8 and are sandwiched between capacitor arrays 1 and 2. The cylindrical ferrite inductors 11 are embedded in a gasket 10, made of a resilient material such as rubber, and which serves to isolate both the cylindrical ferrite inductors and the capacitor arrays from stresses and shocks.

The planar capacitor arrays continue to be completely isolated in all directions, yet assembly of the isolation structure simply involves insertion of the inductors 11 into gasket 10, and insertion into the housing 20 of the remaining elements as shown.

As with the simpler capacitive filter embodiment depicted in FIG. 4, each of the capacitive filter arrays of this embodiment are connected to ground through a grounding spring 4 which may be formed of a single piece of stamped metal as shown or of two discrete springs. The type of conductive material used to form the grounding springs is optional, of course. The inductors are preferably cylindrical ferrite elements.

It will be noted that gaskets 10, 15 and 16 will also provide protection for the planar filter arrays in respect to environmental degradation due to pollutants and moisture by forming a seal with the housing 20 of the connector.

Those skilled in the art will appreciate that numerous modifications of the invention are possible. For example, the resilient planar gaskets of the invention may be used with filters other than simple capacitive and pi filters, and in contexts other than that of multi-pin connectors.

The stress isolation provided by the gaskets will find application in protecting diverse delicate components which may be placed in a connector. Of course, the housing shell need not be rectangular as shown, but rather may be of any shape, and in particular may be cylindrical, the corresponding planar filters and gaskets in that case also being round.

Consequently, it will be appreciated that the scope of the invention should be limited solely by the appended claims.

What is claimed is:

1. An electrical connector, comprising a connector housing and a substantially planar filter array sandwiched between substantially planar resilient members located within said housing, said planar resilient members being arranged to isolate said filter array from mechanical and thermal stresses to which the housing is subject, and further comprising grounding springs arranged between said housing and said array to electrically connect said housing with said filters, said grounding springs being arranged to support said array in said housing and to further isolate said array from shocks.

2. An electrical connector as claimed in claim 1, wherein said filter array is a capacitive filter array.

3. An electrical connector as claimed in claim 2, further comprising a second capacitive filter array and cylindrical inductors arranged to form pi filters, said cylindrical inductors being embedded in one of said resilient members which is sandwiched between said capacitor arrays.

4. An electrical connector as claimed in claim 1, wherein said planar resilient members are made of silicon rubber.

5. An electrical connector as claimed in claim 1, wherein said housing is aluminum.

6. An electrical connector, comprising a connector housing and a substantially planar capacitive filter array sandwiched between substantially planar resilient members located within said housing, said planar resilient members being arranged to isolate said filter array from mechanical and thermal stresses to which the housing is subject, wherein said capacitive filter array is formed of ceramic dielectric material having a plurality of electrodes embedded therein and a plurality of apertures, said plurality of electrodes including pin electrodes exposed at said apertures and electrically connected to spring contact means for electrically connecting said pin electrodes with connector pins, and said plurality of electrodes also including grounding electrodes a portion of which extends around the perimeter of said array, said grounding electrodes being electrically connected to said housing by a grounding spring arranged to support and further isolate said array from mechanical and thermal stresses.

* * * * *